US005160148A

United States Patent [19]

Musacchia, Sr.

[11] Patent Number: 5,160,148

[45] Date of Patent: Nov. 3, 1992

[54] BROADHEAD ARROWHEAD

[76] Inventor: John Musacchia, Sr., 3705 SW. 42nd Pl., Gainesville, Fla. 32608

[21] Appl. No.: 848,164

[22] Filed: Mar. 10, 1992

[51] Int. Cl.[5] ..... F42B 6/08

[52] U.S. Cl. ..... 273/422; 30/303

[58] Field of Search ..... 273/422, 421, 419–420; 30/303

[56] References Cited

U.S. PATENT DOCUMENTS

| | | | |
|---|---|---|---|
| 2,940,758 | 6/1960 | Richter | 273/106.5 |
| 3,741,542 | 6/1973 | Karbo | 273/106.5 |
| 3,887,186 | 6/1975 | Matlock, Jr. | 273/106.5 |
| 4,029,319 | 6/1977 | Christen | 273/106.5 |
| 4,349,202 | 9/1982 | Scott | 273/422 |
| 4,558,868 | 12/1985 | Musacchia | 273/422 |
| 4,643,435 | 2/1987 | Musacchia | 273/422 |
| 4,986,550 | 1/1991 | Segovia | 273/422 |

*Primary Examiner*—Paul E. Shapiro

*Attorney, Agent, or Firm*—Richard C. Litman

[57] ABSTRACT

A broadhead arrowhead includes an elongated ferrule to which are removably attachable a plurality of separate blade members. Each blade comprises an enlarged main portion preferably exhibiting a sharpened outer edge, and a longitudinally extending mounting flange portion. The latter is offset from the former by a fixed angular amount and this offset corresponds to the angular disposition between any two adjacent ones of a plurality of radial slots formed in the ferrule. All of the slots communicate with a central, axial passageway within the ferrule and which extends through its tip. Attachment of the blades is accomplished by sliding each blade rearwardly through the ferrule leading end, with the apex of the angularly offset blade portions passing into the ferrule axial passageway as the two blade portions slide into two separate, adjacent ferrule slots. Remaining blades are similarly attached, with the flange portion of one blade being inserted into the same slot as occupied by the main body portion of an adjacent blade. The width of the ferrule slots is formed to insure a close sliding fit when the above portions of two blades are disposed therein. Secure anchorage of the installed blades is achieved as a notch formation at the rear of each blade straddles a mating formation adjacent the rear of the ferrule slots and tangs on the front of the blades are captively retained upon the application of a removable tip member to the leading end of the ferrule.

13 Claims, 1 Drawing Sheet

BROADHEAD ARROWHEAD

FIELD OF THE INVENTION

This invention relates generally to arrowheads and more particularly, to an improved broadhead as employed with hunting arrows.

BACKGROUND OF THE INVENTION

The most popular arrowhead utilized for hunting, especially medium and large game, is the broadhead. This type of arrowhead comprises one or more blades presenting at least a pair of inclined sharpened edges radially projecting from an elongated hub or ferrule, the latter of which usually includes means facilitating the attachment of the broadhead assembly to the tip of an arrow shaft. The lifespan of these broadheads is affected by several items, the most detrimental of which is damage to the blades due to impact with rocks or the like, such as encountered following missed shots. When a blade breaks or its sharpened edge even becomes severely nicked, the broadhead is useless. For this reason, most broadheads comprise removable blades allowing the user to either replace a damaged blade with a new one or, remove any blade to hone its cutting edge should it merely be dull or only slightly nicked. Most broadheads comprise either one double-edged blade or, two interlocking double-edged blades. With either type of arrowhead, the critical feature resides in the manner of anchorage of the blade(s) since several features of the so-equipped arrow depend upon this attachment.

DESCRIPTION OF THE RELATED ART

Numerous efforts have been expended toward producing broadheads having removable/replaceable blades. An early example will be found in U.S. Pat. No. 2,940,758 issued to Richter on Jun. 14, 1960 and wherein three blades are seated in individual grooves on a ferrule and retained solely by front and rear tangs respectively fitting within a tip and the front of the arrow shaft. The concept of using peripheral grooves to seat blades is also shown in U.S. Pat. No. 4,349,202 issued Sep. 14, 1982 to Scott. In this latter instance, a pair of interlocking double-edged blades are retained by rearmost tangs disposed within a locking ring at the tip of the arrow shaft. Broadheads comprising pairs of interlocking, disparate, double-edged blades are exemplified in U.S. Pat. Nos. 3,741,542, 3,887,186 and 4,029,319, respectively issued to Karbo on Jun. 26, 1973, Matlock, Jr. on Jun. 3, 1975 and Christen on Jun. 14, 1977 and which employ various slots, grooves and/or openings to retain the blades upon a ferrule or the like. Also, it is known to attach blades in a broadhead by means of slots fully passing transversely or radially through a ferrule, as in my earlier U.S. Pat. Nos. 4,558,868 issued Dec. 17, 1985 and 4,643,435 issued Feb. 17, 1987. In these latter broadheads, a plurality of blades defining a rigid sub-assembly, are replaceable only as a complete unit. None of the above prior art is seen to even remotely suggest the unique combination as presented herein.

SUMMARY OF THE INVENTION

By the present invention, an improved broadhead arrowhead is provided including three separate blade members of similar configuration. Each blade member is formed with a substantially planar main body section of generally triangular shape, joined to an angularly offset mounting flange preferably extending the length of the blade member. These flanges define an included angle of 120 degrees with the main body sections and this disposition serves to allow for a quick, simple mounting and/or removal of the blade members relative an especially formed ferrule. The ferrule includes three longitudinal slots, opened at the tip of the ferrule and flaring outwardly, short of the rear of the ferrule. Each slot is of a width selected to closely accommodate twice the thickness of the blade member stock. In this manner, any one slot receives not only a portion of the main body of one blade member but also, the flange portion of one other blade member. The ready broadhead comprises three blade members radially projecting from the ferrule and arcuately spaced apart from one another 120 degrees. To retain the mounted blades in this seated condition, the ferrule tip is threaded to accommodate a removable tip element and which captivates forward points on the blade members.

Accordingly, one of the objects of the present invention is to provide an improved broadhead arrowhead including a ferrule provided with a trio of angularly spaced apart slots each communicating with a central, axial passageway and within which three similarly constructed blade members are inserted for a secure anchorage.

Another object of the present invention is to provide an improved broadhead arrowhead including a ferrule having a plurality of equi-spaced radial slots each receiving overlying portions of two adjacent blade members and supporting the blade members along substantially their full length.

A further object of the present invention is to provide an improved broadhead arrowhead including replaceable blades each having a main body portion joined to a mounting flange portion at an angle of 120 degrees with the juncture between these portions adapted to be disposed within a central, axial passageway as formed in a ferrule having three radial slots communicating with the passageway.

Still another object of the present invention is to provide an improved broadhead arrowhead including a plurality of similarly configured blade members each having a V-shaped mounting area extending substantially the full length of the members and terminating in a rearmost notch adapted to engage a mating configuration within a slotted ferrule to axially and radially secure the blade members relative the ferrule.

With these and other objects in view which will more readily appear as the nature of the invention is better understood, the invention consists in the novel construction, combination and assembly of parts hereinafter more fully described, illustrated and claimed.

Preferred and practical embodiments of the invention are shown in the accompanying drawings, in which:

BRIEF DESCRIPTION OF THE DRAWINGS

Similar reference characters designate corresponding parts throughout the several figures of the drawings.

DESCRIPTION OF THE PREFERRED EMBODIMENT

Figure 1:
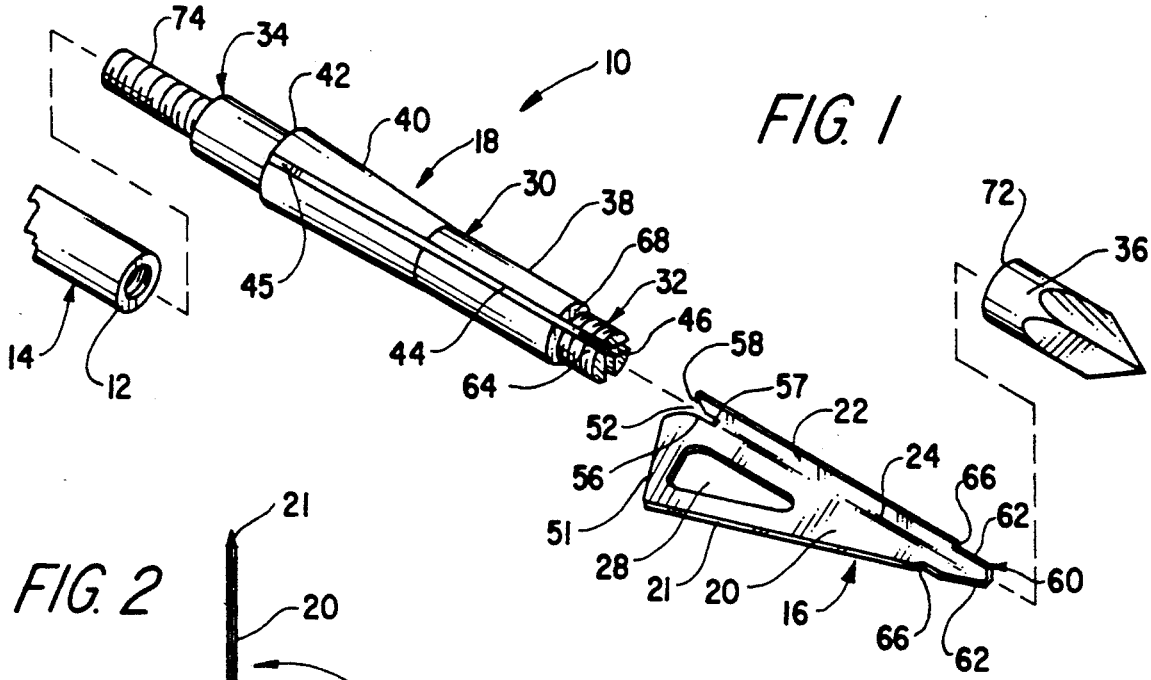
FIG. 1 is an exploded perspective view of the broadhead of the present invention.

Referring now to the drawings, the present invention will be seen to relate to a broadhead arrowhead, generally designated 10 and which is adapted to be removably affixed to the front 12 of a suitable arrow shaft 14. The broadhead 10 comprises a plurality of identically configured blades or blade members 16, preferably three such blades and which are specifically constructed to cooperate in a unique manner with an elongated ferrule 18, so that any one or more of the blades 16 may readily be removed and replaced. In the fully assembled position as in FIG. 4 of the drawings, a superior, rigid attachment is achieved and wherein not only are the ends of the blades positively secured to the ferrule but also, the entire length of each blade is locked against radial displacement relative the ferrule.

Figure 2:
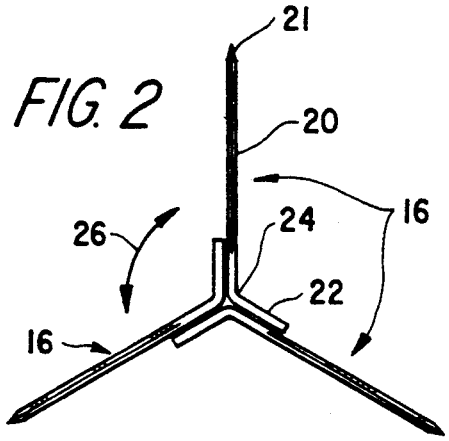
FIG. 2 is a front end elevation of the three blade members as used with the ferrule of FIG. 1.

FIGS. 1 and 2 most clearly illustrate the construction of the blade members 16. Each blade comprises an integral metal member of constant thickness which is stamped or otherwise formed to provide a planar main body portion 20 representing the majority of the stock of the blade member and which is joined to an angularly offset mounting flange portion 22 along an apex comprising the bend line 24 between the two blade portions. The apex or bend line 24 and flange portion 22 will be seen to extend substantially the full length of the blade member 16, for reasons which will be appreciated hereinafter. As is known in the broadhead art, the inclined outer edges 21 may be sharpened.

In the case of the three-bladed broadhead 10 as illustrated herein, the included angle 26 between the two blade portions 20,22 will be understood to be 120 degrees. The window or cutout 28 provided in each blade 16 not only reduces the mass of the broadhead to avoid an excessively front-end heavy arrow but also facilitates the bleeding action following a hit, to encourage the most humane kill.

The above blades 16 are retained in a rigid, assembled condition by the ferrule 18 which comprises an elongated member, presenting a circular configuration in cross-section, constructed either of metal or plastics and which includes a main body 30 terminating in a threaded forward portion 32 and an opposite arrow shaft mounting portion or tang 34. The forward portion 32 defines a reduced diameter member adapted to receive an internally threaded arrowhead tip, such as the illustrated trocar tip 36 as will be described later. The main body 30 of the ferrule comprises the majority of the ferrule length and includes a front section 38 having a constant diameter, joined to a rear section 40 flaring outwardly toward its rear shoulder 42, thus defining a substantially frusto-conical formation.

Figure 3:
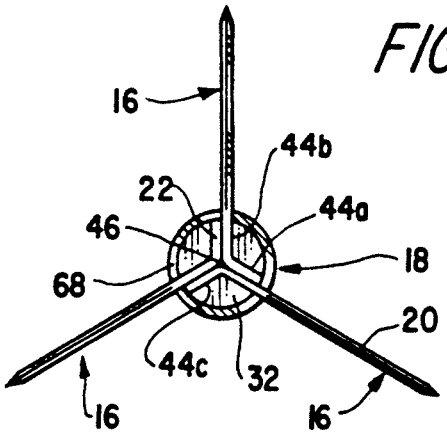
FIG. 3 is a front end elevation of the assembled broadhead with the tip element omitted for purposes of clarity.
Figure 4:
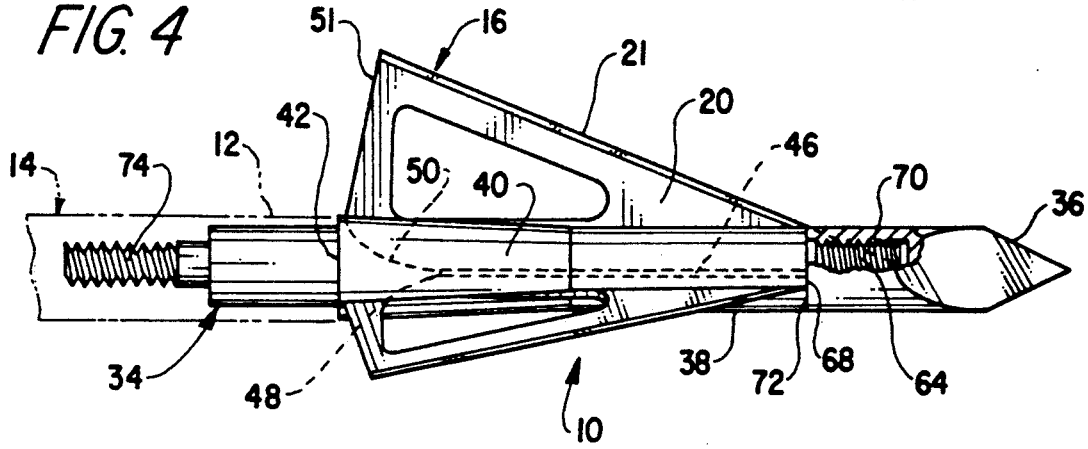
FIG. 4 is a right side elevation of the assembled broadhead with portions of the ferrule broken away to illustrate details of the mounted blade members.

The individual blade members 16 are attached to the ferrule by means of a plurality of slots 44, equal in number to the number of blades. Accordingly, three such slots 44 will be seen in the embodiment as illustrated most clearly in FIGS. 1, 3 and 4. Each slot extends longitudinally, from the distal portion of the forward portion 32, rearwardly toward the ferrule shoulder 42. The central axis of the ferrule includes a bore or passageway 46, extending rearwardly from the distal portion of the forward portion 32, to a point 48 which as shown in FIG. 4 is medially located within the ferrule rear section 40. All of the slots 44 project radially from the center axis of the ferrule and communicate with the passageway 46. With three such slots symmetrically arranged, it follows that each is arcuately spaced from the other by 120 degrees, the same offset 26 as between the main body and mounting flange portions of the blades 16.

An important feature of the slots 44 is that each defines a width that is only slightly larger than the combined thickness of the material of two of the similarly constructed blades 16, for reasons which will become obvious hereinbelow. Rearwardly of the axial point 48 representing the rear terminus of the central passageway 46, the slots may more accurately be considered grooves 45 having a bottom or inner limit formed by a ramp surface 50, inclined outwardly toward the perimeter of the rear shoulder 42.

With the above construction in mind, the attachment and anchorage of the blades 16 may be described. Each blade is inserted rearwardly toward the front portion 32 of the ferrule 18 with its flange portion 22 entering one ferrule slot **44*a* and its main body portion 20 entering an adjacent slot 44*b***. As the offset between the two blade portions as well as the two adjacent ferrule slots is 120 degrees and the width of the slots is no less than twice the thickness of a blade stock, it follows that an unimpeded insertion will be achieved.

The rear edge 51 of each blade is provided with a recess or notch 52 having its apex 54 coincident with the bend line 24 of the blade and which is formed by two divergent edges 56,58 respectively on the main body and flange portions. As the blade is fully seated within the ferrule, the edges 56,58 will be understood to straddle and engage two adjacent ones of the ramp surfaces 50,50 to provide a fixed anchorage at the rear of the blade. When thusly seated, a front tang 60 on the blade is disposed within the confines of the ferrule forward portion 32. The tabs or edges 62,62 forming this tang are extensions of and cut back from the material of the blade portions 20,22 to closely conform to the root diameter of the threads 64 and these edges will be seen to lead rearwardly to radial shoulders 66,66 on the respective blade portions. When the blade member is fully seated, these shoulders 66,66 are flush with the surface of the front ferrule face 68 at the rear of the threads 64.

Following the insertion of a first one of the blades 16, a second similar blade is likewise installed, with its main body portion 20 entering the same slot **44*a* as occupied by the flange portion 22 of the first installed blade and while the flange portion of the second blade is inserted into the remaining ferrule slot 44*c*. Thereafter, the final, third blade 16 is installed in the same manner, with its main body portion 20 entering the slot 44*c* and flange portion entering the slot 44*b*. The assembly will then appear as in FIG. 3 and wherein it will be seen that the flange portion 22 of each blade 16 is disposed within a slot 44 as occupied by the main body portion 20 of another one of the blades. Recalling that the combined thickness of any two blade portions results in a very close fit within each of the three slots 44, it will be appreciated that a firm fit of the assembled blades will exist, as all three blade bend lines 24 are juxtaposed one another within the ferrule axial passageway 46**.

A final anchorage of the above assembly is achieved by the application of the tip member 36 and wherein its internal threads 70 engage the ferrule threads 64. The tip member is tightened until its rear face 72 abuts the front shoulder 68 of the ferrule. This action effectively captivates and anchors the front tangs 60 of the blade members 16 within the ferrule forward portion 32. In this manner, the blades will be seen to be securely anchored relative the ferrule 18. The seated rear notches 52 and front tangs 60 retain the two ends of all of the blades while the continuous, uninterrupted bend line 24 of the blades positions the two offset blade portions in radially distinct ferrule slots to provide a locking support of the entire length of the blades.

A complete arrowhead as above is readily affixed to the forward end 12 of an arrow shaft 14 by means of the mounting tang 34 projecting from the rear of the ferrule shoulder 42. Any suitable attachment technique may be employed as is well known in the art, such as the illustrated threaded stud 74 mating with a threaded insert 76 in the arrow shaft. To maintain ideal aerodynamics, the periphery of the ferrule rear shoulder 42 is preferably congruent with the periphery of the arrow shaft tip 12.

It will be appreciated that the above construction provides an improved mounting and anchorage of the blades of a broadhead arrowhead both during launch and following impact. As a arrow is released from an archery bow, the components of a broadhead are urged rearwardly by inertia. The disposition of the rear notch apex 57 coincident with the bend line 24 along the ferrule central axis, concentrates any rearward forces upon the point or apex 48 of the rear ramp surfaces 50. Any tendency of a blade to fly outwardly is minimized in view of its captivity between the tip member 36 and ferrule apex 51, together with the offset disposition of the two blade portions in the offset ferrule slots. And even upon impact, when inertial forces tend to drive the blade members forwardly against the halted tip member 36, the interlock of the blade ends has been found to exhibit strong resistance to blade separation.

It is to be understood that the present invention is not limited to the sole embodiment described above, but encompasses any and all embodiments within the scope of the following claims.

I claim:

1. A broadhead arrowhead comprising;

a ferrule having a main body provided with an outer periphery, opposite front and rear end portions extending from said main body, said ferrule including an axial passageway extending substantially through the length of said main body and projecting through said front end portion, said ferrule main body and front end portion provided with a plurality of outwardly radiating slots communicating with said axial passageway, adjacent pairs of said plurality of slots defining a similar included angle therebetween, a plurality of individual blade members each including a main body portion joined to an angularly offset mounting flange portion along a longitudinal bend line, said main body portion and mounting flange portion of each said blade member having a substantially equal thickness and defining an included angle therebetween which is equal to said included angle between adjacent pairs of said plurality of ferrule slots, said slots having a width no less than twice the thickness of any one said blade member main body portion or mounting flange portion, a plurality of said blade members equal in number to the number of said slots inserted within said ferrule slots with said bend line of each said blade member disposed within said axial passageway and with said main body portion and mounting flange portion of each said blade member occupying adjacent ones of said slots, whereby with all said plurality of blade members disposed within said plurality of ferrule slots, each said slot is occupied by one said mounting flange portion of one said blade member and one said main body portion of another one said blade member, and means engaging said ferrule precluding unwanted axial displacement of said blade members disposed within said ferrule slots.

2. A broadhead arrowhead according to claim 1 including, three of said slots in said ferrule and wherein, said included angles are substantially 120 degrees.

3. A broadhead arrowhead according to claim 1 wherein, the radius of said ferrule slots is substantially equal to the width of said blade member mounting flange portions.

4. A braodhead arrowhead according to claim 1 wherein, said front portion on said ferrule defines a lesser diameter than said ferrule main body adjacent thereto, and said engaging means comprises a tip member removably attached to said front portion and abutting said ferrule main body.

5. A broadhead arrowhead according to claim 4 including, external threads on said ferrule front portion, said blade members each including a front tang disposed within said ferrule front portion and having a radial extent no greater than the root of said external threads, and a tip member having internal threads permitting of removable attachment of said tip member to said ferrule front portion.

6. A broadhead arrowhead according to claim 1 including, an inclined sharpened outer edge on each said blade member.

7. A broadhead arrowhead according to claim 1 wherein, said front portion on said ferrule defines a lesser diameter than said ferrule main body adjacent thereto, each said blade member having a forwardmost tang comprising extensions of said main body and mounting flange portions.

8. A broadhead arrowhead according to claim 1 including, a rear terminus of said axial passageway disposed at a point forward of said ferrule rear portion with said slots each communicating with a groove having a bottom ramp extending rearwardly of said terminus point, and said blade members provided with a rear edge including a recess therein having an apex, whereby said blade member apex is juxtaposed said axial passageway terminus point to rearwardly seat said blade members within said ferrule.

9. A broadhead arrowhead according to claim 1 wherein, said ferrule rear end portion includes a mounting tang axially extending from said main body, and said mounting tang having attachment means thereon adapted to engage a front tip of an arrow shaft.

10. A broadhead arrowhead according to claim 1 wherein, said blade member bend line comprises a continuous, uninterrupted body of material extending at least the majority of the length of said blade member.

11. A broadhead arrowhead comprising;

an elongated ferrule provided with an outer periphery, said ferrule having a front end and including a central axial passageway opening through said front end, a plurality of slots communicating with and radiating outwardly from said central axial passageway and through said outer periphery, adjacent ones of said slots defining an angular offset disposition therebetween when said ferrule is viewed in end elevation, a plurality of blade members each including first and second angularly offset portions when viewed in end elevation, said blade members mounted within said ferrule each with its said first and second angularly offset portions respectively inserted within an adjacent pair of said ferrule slots and with one said blade member first offset portion disposed in a same one said slot as one said second offset portion of another one said blade member, and said plurality of blade members mounted within said ferrule having said second offset portions substantially flush with said ferrule outer periphery with said first offset portions radially projecting a substantial distance from said ferrule outer periphery.

12. A broadhead arrowhead according to claim 11 including, three of said slots in said ferrule, and said blade member first and second portions angularly offset substantially 120 degrees.

13. A broadhead arrowhead according to claim 11 including, an inclined sharpened outer edge on each said blade member first portion.

* * * * *